US005908103A

United States Patent [19]

Dlugos

[11] Patent Number: 5,908,103

[45] Date of Patent: Jun. 1, 1999

[54] TOKEN WITH WIEGAND WIRE

[75] Inventor: David J. Dlugos, Beacon Falls, Conn.

[73] Assignee: HID Corporation, Irvine, Calif.

[21] Appl. No.: 08/985,598

[22] Filed: Dec. 5, 1997

[51] Int. Cl.[6] ..... G07F 7/00; G05G 1/00; G09F 3/00

[52] U.S. Cl. ..... 194/210; 194/213; 194/214; 40/27.5

[58] Field of Search ..... 194/210, 214, 194/213; 40/27.5

[56] References Cited

U.S. PATENT DOCUMENTS

| | | | |
|---|---|---|---|
| 3,766,452 | 10/1973 | Burpee et al. | 40/27.5 |
| 3,820,090 | 6/1974 | Wiegand | 365/133 |
| 4,008,458 | 2/1977 | Wensley . | |
| 4,185,730 | 1/1980 | Roes et al. . | |
| 4,247,601 | 1/1981 | Wiegand | 428/611 |
| 4,263,523 | 4/1981 | Wiegand | 307/419 |
| 4,484,090 | 11/1984 | Wiegand et al. . | |
| 4,553,657 | 11/1985 | Kilmartin et al. . | |
| 4,593,209 | 6/1986 | Sloan | 307/419 |
| 4,736,122 | 4/1988 | Opie et al. | 307/419 |
| 4,743,780 | 5/1988 | Opie . | |
| 4,758,742 | 7/1988 | Opie . | |
| 5,216,234 | 6/1993 | Bell . | |
| 5,498,859 | 3/1996 | Farmont | 40/27.5 |
| 5,706,925 | 1/1998 | Orus et al. | 194/214 |

FOREIGN PATENT DOCUMENTS

| | | | |
|---|---|---|---|
| 4021-770 | 1/1992 | Germany | 194/214 |

OTHER PUBLICATIONS

Sensor Engineering Co. (an Echlin Co.) 1990 "Zero Power Wiegand Sensor" 2 pgs.

*Primary Examiner*—F. J. Bartuska
*Assistant Examiner*—Bryan J. Jaketic
*Attorney, Agent, or Firm*—McAulay Nissen Goldberg Kiel & Hand, LLP

[57] ABSTRACT

A Wiegand token essentially is comprised of a disk-like token body that has two substantially flat surfaces, one of the flat surface including a groove, for example, a circular groove, therein, and a Wiegand wire is embedded within the groove of the token body. The Wiegand token may have multiple concentric grooves with a Wiegand wire embedded within each groove. In general, the Wiegand token is for use in a device having a read head that responds to a magnetic field change generated from a switch in state of the Wiegand wire as the token passes by the read head. When the token includes plural Wiegand wires therein, the read head responds separately to each magnetic field change generated from a switch in state of each Wiegand wire as the respective Wiegand wire passes by the read head. Moreover, the read head separately responds to magnetic field changes that are generated from a switch in state of two different segments of the Wiegand wire as the respective segment passes by the read head. A method of producing the Wiegand token involves forming a groove within a flat surface of a token body, and embedding a Wiegand wire within the groove of the token body to produce the Wiegand token.

17 Claims, 3 Drawing Sheets

FIG.2A
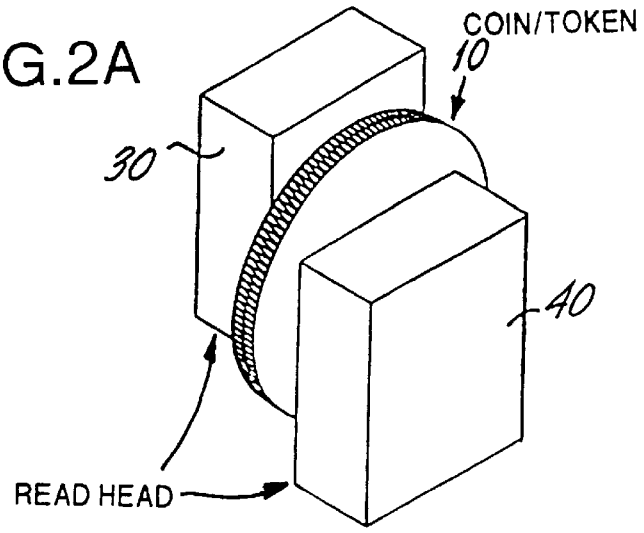
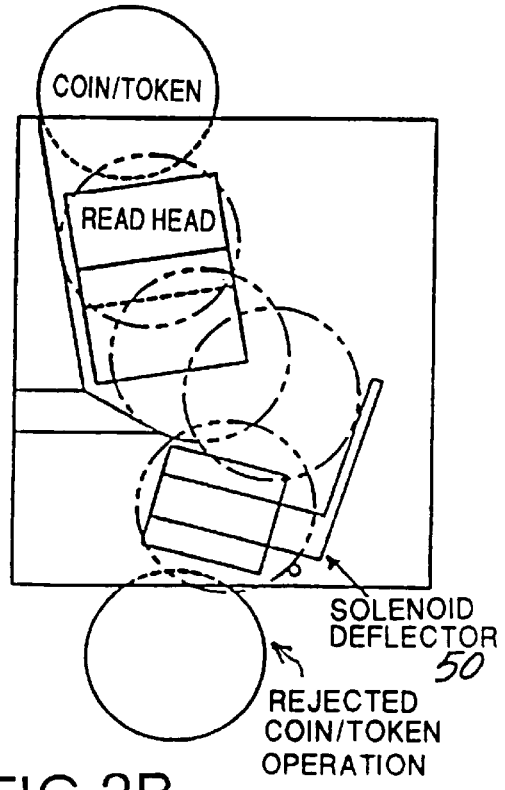
FIG.2B
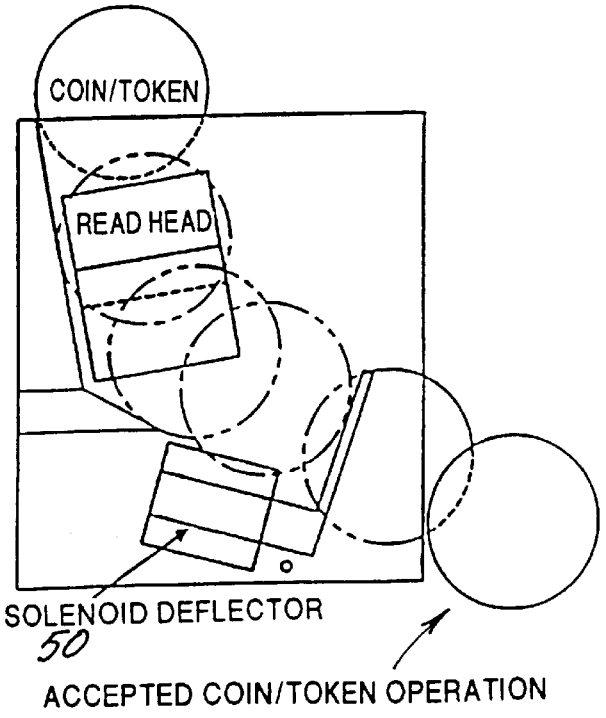
FIG.2C

TOKEN WITH WIEGAND WIRE

BACKGROUND OF THE INVENTION

This invention relates to a coin or token having a Wiegand wire therein, and is particularly directed to a coin or token having one or more Wiegand wires therein for use in coin-operated machines, such as gambling machines, which are capable of detecting the insertion of such coins/tokens.

The gambling industry incurs a substantial loss in revenue due to the existence and use of counterfeit tokens and counterfeit coins (often called slugs) in gambling machines. When mass produced, counterfeit coins and tokens are relatively inexpensive to manufacture since they generally only need to have the same dimensions and weight of the authentic coin/token.

While there have been previous attempts to manufacture a token that is difficult to counterfeit, such attempts have fallen short of industry requirements. Such requirements generally call for expected savings that far outweigh the cost of converting existing and new gambling machines to recognize and only accept the proposed "counterfeit proof" token.

It is therefore an object of this invention to provide a token which is impossible or, at least, exceedingly difficult to counterfeit.

It is another object of this invention to provide a token which is difficult to counterfeit, but which is relatively easy to manufacture.

Various other objects, advantages and features of the present invention will become readily apparent to those of ordinary skill in the art, and the novel features will be particularly pointed out in the appended claims.

SUMMARY OF THE INVENTION

In accordance with one embodiment of the present invention, a token is comprised of a token body that has two substantially flat surfaces, one of the flat surface including a groove therein, and a Wiegand wire that is embedded within the groove of the token body.

As an aspect of the present invention, the groove and Wiegand wire are substantially circular in shape.

As another aspect of the present invention, one of the surfaces of the token body includes a plurality of concentric circular grooves therein, and a Wiegand wire is embedded within each groove.

As a further aspect of the present invention, the token body includes a groove within the other flat surface, and a Wiegand wire is embedded within the other groove. As a feature of this aspect, the grooves within the two flat surfaces are located at corresponding positions in the token.

As an additional aspect, the token is combined with a read head that responds to a magnetic field change generated from a switch in state of the Wiegand wire in the token as the token passes by the read head. As a feature of this aspect, the token body includes plural grooves and a Wiegand wire is embedded within each groove, and the read head responds separately to each magnetic field change generated from a switch in state of each Wiegand wire as the respective Wiegand wire passes by the read head.

As yet another aspect, a read head responds to each magnetic field change generated from a switch in state of each of two different segments of the Wiegand wire as the respective segment passes by the read head.

In accordance with another embodiment of the present invention, a method of producing a Wiegand token is carried out by forming a groove within a flat surface of a token body, and embedding a Wiegand wire within the groove of the token body to produce the Wiegand token.

As various aspects of this method, the groove may be circular in shape, and a Wiegand wire may be embedded within each of a plurality of grooves formed in the token body.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which:

FIG. 2A is a perspective view of a token passing between two read heads in accordance with the present invention, and FIGS. 2B and 2C schematically illustrate the respective paths of a token that is rejected and accepted, respectively, within a device that is capable of detecting the token with Wiegand wire of the present invention;

DETAILED DESCRIPTION OF CERTAIN PREFERRED EMBODIMENTS

Figure 1A:
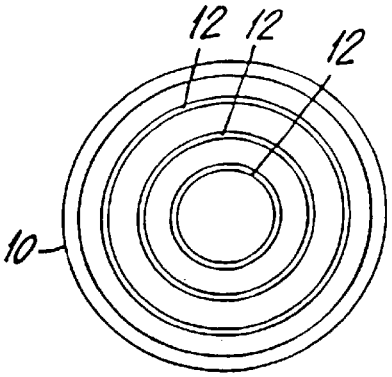
FIGS. 1A–1D and 1F–1G are different views of a token with Wiegand wire in accordance with the present invention.
Figure 1B:
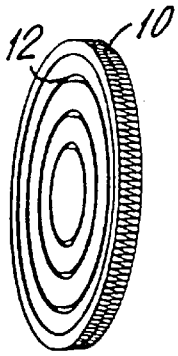

Referring now to FIGS. 1A–1G, the Token with Wiegand Wire in accordance with the present invention (hereinafter, "Wiegand Token" or "Wiegand Wire Token") essentially is a token body 10 with one or more grooves 12 therein, with a wherein Wiegand wire 20 in the shape of a ring (FIG. 1E) embedded within each groove 12. Token body 10 is flat, disk-shaped and made of any appropriate non-magnetic material. The token body 10, together with one or more Wiegand wires therein, is injected molded, or the like, to hold the Wiegand wires in place. A top surface 14 (shown in FIGS. 1C, 1D and 1F) of the Wiegand token may be applied with custom printing. The rear surface 16 of the Wiegand token likewise may be applied with custom printing.

The Wiegand wire is a ferro magnetic wire having core and shell portions with divergent magnetic properties. The currently preferred type of Wiegand wire is disclosed in U.S. Pat. No. 4,247,601, issued on Jan. 27, 1981, and which is incorporated herein by reference. Read heads which are effective to provide an output pulse from a switch in state of the Wiegand wire are described in U.S. Pat. No. 4,263,523, issued Apr. 21, 1981, and U.S. Pat. No. 4,593,209, issued Jun. 3, 1986. A module employing the Wiegand wire that is effective to generate a pulse in response to a change in magnetic field is described in U.S. Pat. No. 4,484,090, issued Nov. 20, 1984.

Read heads for use with a Wiegand wire are currently employed in various access systems. Codes are incorporated in access cards and keys where the Wiegand wire is employed in the card or key to provide the encoding. One technique of positioning these wires in the access card and for reading the wires as the wires are passed over the face of a read head is described in said U.S. Pat. No. 4,593,209. The manner in which the Wiegand wires are encoded on a code strip carried in an access card is described in connection with the discussion of FIGS. 5 and 6 in said U.S. Pat. No. 4,593,209. As shown therein, the "zero" bit wires are all parallel to one another in a single column like the rungs of a ladder. The "one" bit wires are also parallel to one another in a single column. However, the center lines of the two columns are spaced from one another. Thus, the zero bits are read by one portion of the read head and the one bits are read by another portion of the read head. U.S. Pat. No. 4,736,122 discloses an improved read head of those devices discussed in the patents mentioned above. As shown in FIG. 1 of U.S. Pat. No. 4,736,122, the read head described therein is E-shaped with a polarized magnet at each of the three legs and the magnets are sandwiched between a thin yoke and a thick yoke. The thin and thick yokes forming set and reset fields, respectively.

Unlike the access systems mentioned above, the Wiegand token of the present invention provides security as to authenticity, not by the particular arrangement of one and zero bits as in an access card, but by the number of Wiegand rings and the distances between those rings in the Wiegand token. Of course, the weight, size and shape of the Wiegand token itself may be taken into account. In FIGS. 1A–1D, a Wiegand token is shown as including three circular grooves in which three Wiegand wire rings are imbedded. Given a token diameter of, for example, 1.5 inches and a distance between the Wiegand wire rings of, for example, 0.2 inches, a token having this exemplary diameter, number of rings and particular distance between rings can be said to have a particular, e.g., monetary, value. As another example, a 1.7 inch diameter Wiegand token having four wire rings therein, and a ring distance of 0.1 inches can be said to have a different, predetermined monetary value. Thus, the Wiegand token may have any desired diameter, any appropriate number of Wiegand wire rings embedded therein and any appropriate distance between wire rings. Of course, the distance between adjacent rings may be different from the distance between other adjacent rings within the same Wiegand token. Still further, the particular configuration of the Wiegand token (i.e., size, number of rings, etc.) may represent something other than a particular monetary value, such as a code. For example, a particular Wiegand token may represent an entry code.

In accordance with the present invention, the Wiegand token is for use in a coin operated machine or other device having the novel capability of being able to identify the insertion of the Wiegand token therein. Such novel machine may include a coin/token slot in which the Wiegand token is inserted, two novel Wiegand read heads, a coin/token solenoid deflector and an appropriate processing system. FIG. 2A is a schematic illustration of a Wiegand token 10 passing between two novel Wiegand read heads 30, 40, and FIGS. 2B and 2C schematically illustrate the path of an inserted coin/token, wherein the coin/token is rejected when it is determined to be an unacceptable or non-authentic coin/token (FIG. 2B), and the inserted coin/token is accepted when read heads 30, 40, in conjunction with the appropriate processing system (not shown), determine that the inserted coin/token is authentic (FIG. 2C). Hereinafter, all references to "token" are also intended to include coins and equivalents thereto.

When a token is inserted into the coin slot of a coin operated machine embodying the capability of detecting Wiegand tokens, the token passes by and between both read heads 30 and 40 shown in FIG. 2A. Since the preferred embodiment of the present invention provides Wiegand wire rings 20 only on one side of the Wiegand token (see FIG. IF), two read heads 30, 40 are used to ensure detection of a Wiegand token regardless of the particular orientation of the token during its insertion into the coin operated machine.

Figure 3:
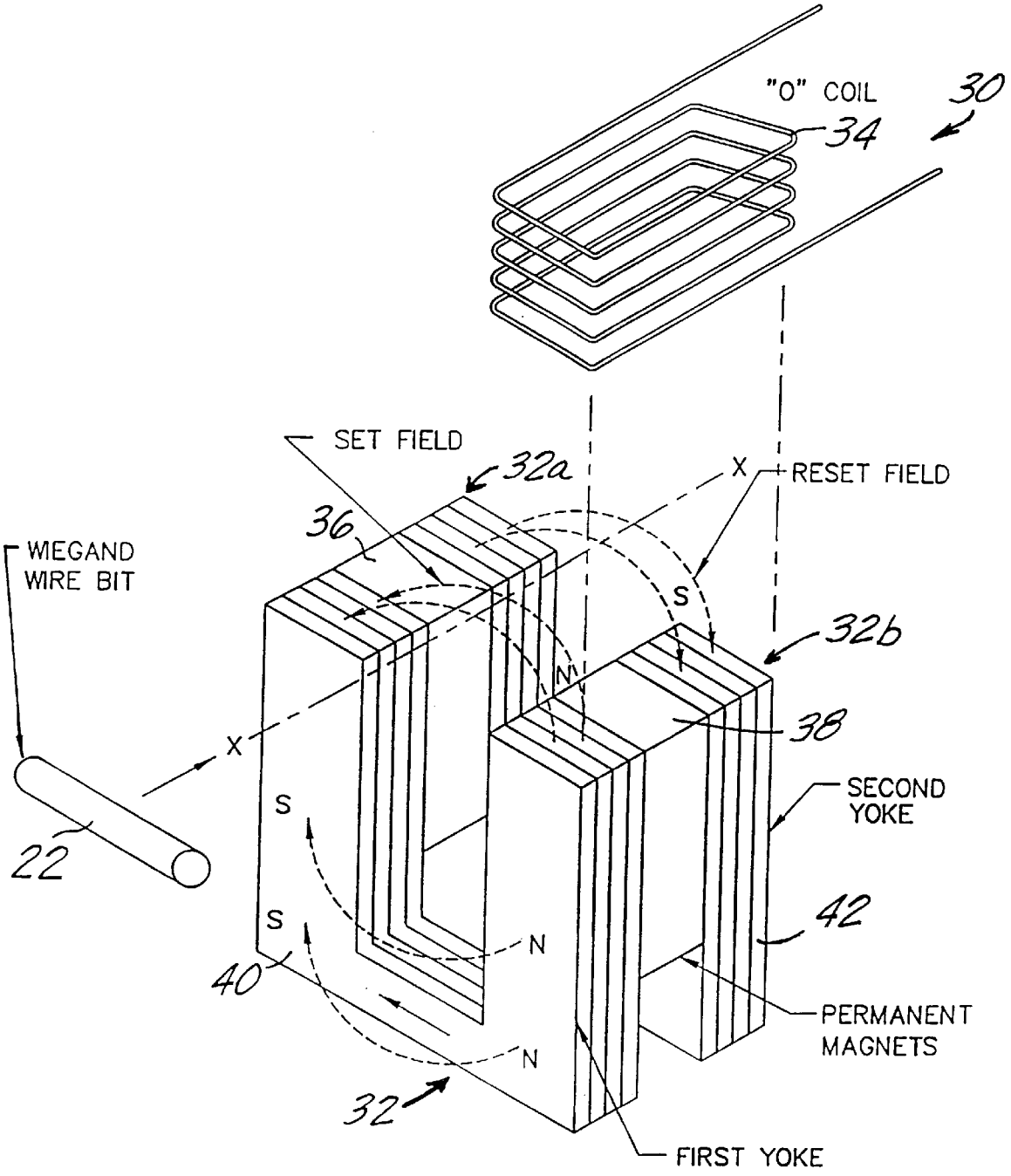
FIG. 3 is a perspective, partially exploded view of a novel read head that is capable of detecting the token with Wiegand wire of the present invention.

FIG. 3 illustrates a novel read head 30 which may be used to detect the Wiegand token of the present invention. Read head 40 in FIG. 2A may be identical to read head 30. As shown in FIG. 3, read head 30 includes a C-shaped core 32 having first and second legs 32*a*, 32*b*. On one of the legs, for example, leg 32*b*, pickup coil 34 is wound. First and second magnets 36, 38 are sandwiched between the legs of first and second ferro magnetic C-shaped yokes 40 and 42, respectively. As shown in FIG. 3, the north pole of magnet 38 is flush against the surface of yoke 40 and the south pole of this magnetic is flush against the surface of yoke 42. The direction of magnetization of the other magnet 36 is opposite from that of magnet 38 so that the south pole of magnet 36 is flush against yoke 40 and the north pole of magnet 36 is flush against yoke 42. The result of this magnetic orientation to the legs of the yokes is the field directions that are shown schematically in FIG. 3.

The C-shaped core 32 and coil 34 constitute read head 30, whereupon the passage of a wire segment 22 of one of the Wiegand wire rings 20, previously discussed, past the face of the read head in the direction and orientation, along the x-axis, shown causes the wire segments to undergo a switch in magnetic state, inducing an electric pulse in pick-up coil 34. In more particular detail, as wire segment 22 travels in the lateral direction shown, it first encounters a first magnetic field due to the leakage flux across the ends of the legs of yoke 40 resulting in the magnetization of wire segment 22 so that its shell and core are magnetized in the same direction. As wire segment 22 continues to pass across the face of read head 30 in the x-axis direction, it encounters another magnetic field adjacent to yoke 42, which field will be in the opposite direction from that of the field adjacent to yoke 40. The second field causes the wire segment 22 to reset. The result of the passage of wire segment 22 over the face of read head 30 is the induction of a significant output pulse in pick-up coil 34. Read head 30 is said to be a symmetric device since yokes 40 and 42 have equal widths.

The read head shown in FIG. 3 produces an electric pulse of opposite polarity if the Wiegand wire segment passes by the face of the read head in the opposite direction, and thus read head 30 detects the direction of motion of the Wiegand wire. However, this feature of read head 30 may not be pertinent to the present invention since it is assumed that the Wiegand token that is inserted into a coin operated machine having read head 30 therein will always pass by the face of read head 30 in the same direction.

As previously discussed, each Wiegand token has imbedded therein at least one Wiegand wire ring. Then, by causing the inserted Wiegand token 10 to pass between the faces of read heads 30, 40 in the manner shown in FIG. 2A (within the coin operated machine), each Wiegand wire ring produces two so-called Wiegand pulses. If a Wiegand token having three Wiegand wire rings imbedded therein is inserted into a coin operated machine having read heads 30, 40, six Wiegand pulses are produced. Assuming the speed of the Wiegand token as it passes between read heads 30, 40 is known, the number of Wiegand wire rings embedded in Wiegand token 10 and the distances therebetween can be ascertained which, in turn, identifies the value of the inserted Wiegand token. Similarly, detection of the number of Wiegand pulses as well as the elapsed time between those pulses also identifies the value of the inserted Wiegand token. The weight, size and shape of the Wiegand token itself also could be utilized as previously mentioned. The particular design of an appropriate processing circuit that is capable of converting a series of pulses, taken into account the time between the pulses, to a value is a matter of ordinary skill, and, therefore, further description thereof is omitted herein. Acceptance or rejection of an inserted token by solenoid deflector 50 (FIGS. 2B and 2C) is easily accomplished in response to the detected value, or the lack of a value, of the inserted token. Hence, tokens and coins not having any Wiegand wires therein will be rejected in a coin operated machine which accepts only Wiegand tokens or accepts only Wiegand tokens having particular values.

Figure 1E:
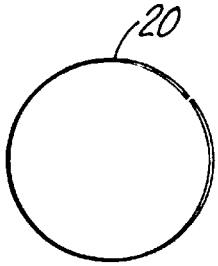
FIG. 1E schematically illustrates a Wiegand wire ring to be embedded in the token with Wiegand wire of the present invention.
Figure 1C:
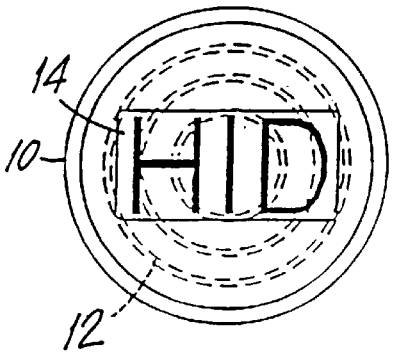
Figure 1D:
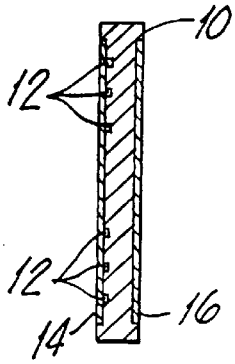
Figure 1G:
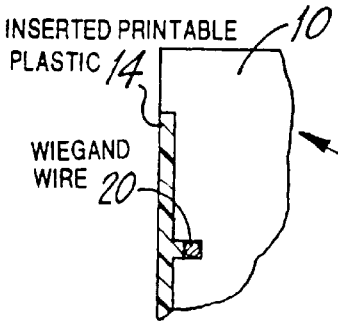

As previously discussed, each Wiegand wire that is embedded in the Wiegand token of the present invention is circular in shape. The Wiegand wire may be open (as shown in FIG. 1E) or closed, but open rings are preferred as they are simpler to construct and result in no loss in performance so long as the opening in each ring is relatively small. The ring or circular shape of the Wiegand wires that are embedded in the Wiegand token provides the advantageous feature that the Wiegand token can be inserted into a coin slot at any orientation. Such Wiegand wire rings also are relatively easy to construct from Wiegand wire that is produced, for example, in the manner disclosed in the U.S. Patents previously mentioned. Accordingly, a process of manufacturing Wiegand tokens in accordance with the present invention is carried out by forming or purchasing a token that is made from any non-magnetic material, forming one or more circular grooves in one side of the token (see FIG. 1B), the grooves preferably being concentric, inserting or embedding an open or closed shaped Wiegand wire ring in each of the grooves, injecting a mold within the grooves to hold the Wiegand wire rings in place, or other equivalent, and optionally custom printing the face of the resultant token (e.g., print the value of the token thereon), or adhere an appropriate label to one or both faces of the token. Of course, other methods of manufacturing the Wiegand token described herein also may be used so long as the resultant Wiegand token has at least one Wiegand wire ring therein.

While the present invention has been particularly shown and described in conjunction with a preferred embodiment thereof, it will be readily appreciated by those of ordinary skill in the art that various changes may be made without departing from the spirit and scope of the invention. For example, while the Wiegand token as described herein contains at least one Wiegand wire that is embedded near one face of the token, the present invention is not limited to this particular arrangement and may encompass tokens having Wiegand wires embedded near both faces of the token. The Wiegand wire rings embedded in the two faces may be arranged at the same location and, thus, only one read head 30 would be needed in a coin operated device to detect the insertion of a Wiegand token. Alternatively, the location of the Wiegand wire rings in the two faces of the Wiegand token may be different resulting in a different detected value of the token depending upon the orientation of the token upon insertion into the coin operated device.

Figure 4:
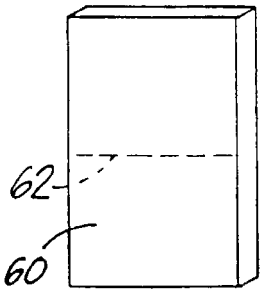
FIG. 4 is a perspective view, partially in phantom, of another token with a Wiegand wire therein in accordance with the present invention.
Figure 1F:
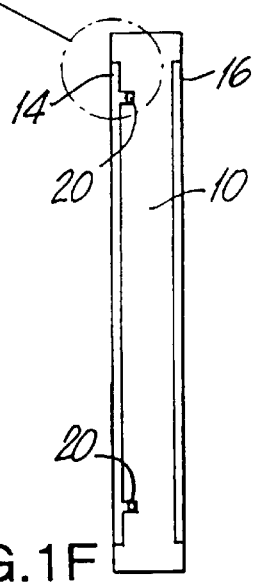

As another example, although the present discussion is directed to Wiegand tokens that are relatively flat and disc shaped, the present invention is not limited solely to this particular shape and may be widely applied to tokens and equivalents thereof that have different shapes, for example, that are not round and/or are not relatively flat. For example, the Wiegand token may have a square shape, a rectangular shape, etc., whereupon a square shaped, a rectangular shaped, a round shaped, etc., Wiegand wire is embedded therein. FIG. 4 is a perspective view of a Wiegand token 60 having a rectangular shape with a straight Wiegand wire 62 (shown in phantom) therein. The rectangular Wiegand token shown will be detected by the above-discussed machines assuming the token is inserted in a particular orientation, such as by providing an insertion slot with an appropriate width and depth. Thus, the present invention includes a token of any shape and size having one or more Wiegand wires of any shape and size therein. While various shaped Wiegand tokens may not be applicable for the gambling industry, it is contemplated that they may useful for other purposes (e.g., for teaching purposes, for entertainment purposes, etc.).

Still further, although the Wiegand token of the present invention has been described as being for use in a coin operated device, the Wiegand token may be used in other types of devices. For example, the Wiegand token described herein may be used for security purposes wherein a device is controlled to perform a particular function in response to the detection of an inserted Wiegand token having a particular value.

Therefore, it is intended that the appended claims be interpreted as including the embodiments described herein, the alternatives mentioned above, and all equivalents thereto.

What is claimed is:

1. A token, comprising:

a token body having two substantially flat surfaces, said token body including a groove within one of the flat surfaces; and a Wiegand wire embedded within the groove of the token body.

2. The token of claim 1, wherein said groove is substantially circular in shape and said Wiegand wire has a shape corresponding to said circular shape of said groove.

3. The token of claim 1, wherein said token body includes a plurality of concentric circular grooves within said one of said flat surfaces; and said token comprises a plurality of Wiegand wires, each of said Wiegand wires being embedded within a respective one of said grooves.

4. The token of claim 1, further comprising an injection mold within said groove of said token body for permanently embedding said Wiegand wire within said groove.

5. The token of claim 1, wherein said token body includes a groove within the other of said flat surfaces; said token further comprising a second Wiegand wire, said second Wiegand wire being embedded within said other groove of said token body.

6. The token of claim 5, wherein the grooves within each of said flat surfaces of said token body are located at corresponding positions in said token.

7. The token of claim 1, wherein said token body is made of a non-magnetic material.

8. The token of claim 1 in combination with a read head responding to a magnetic field change generated from a switch in state of said Wiegand wire in said token as said token passes by said read head.

9. The combination of claim 8, wherein said token body includes a plurality of grooves within said one of said flat surfaces; and said token comprises a plurality of Wiegand wires, each of said Wiegand wires being embedded within a respective one of said grooves; and wherein said read head responds separately to each magnetic field change generated from a switch in state of each of said Wiegand wires in said token as the respective Wiegand wire passes by said read head.

10. The token of claim 1 in combination with a read head, wherein said groove is substantially circular in shape and said Wiegand wire has a shape corresponding to said circular shape of said groove; and said read head responds to each magnetic field change generated from a switch in state of each of two segments of said Wiegand wire in said token as the respective segment of said Wiegand wire passes by said read head.

11. A method of producing a Wiegand token, comprising the steps of:

forming a groove within a flat surface of a token body; and embedding a Wiegand wire within said groove of said token body to produce said Wiegand token.

12. The method of claim 11, wherein said forming step is carried out by forming a substantially circular shaped groove; and said embedding step is carried out by embedding within said groove a Wiegand wire having a shape corresponding to said circular shape of said groove.

13. The method of claim 11, wherein said forming step is carried out by forming a plurality of concentric circular grooves within said one of said flat surfaces; and said embedding step is carried out by embedding a respective Wiegand wire within each of said grooves.

14. The method of claim 11, further comprising the step of injecting a mold within said groove of said token body to permanently embed said Wiegand wire within said groove.

15. The method of claim 11, further comprising the steps of forming a groove within the other of said flat surfaces of said token body; and embedding a second Wiegand wire within said other groove.

16. The method of claim 15, wherein the steps of forming grooves form the two grooves within each of said flat surfaces of said token body at corresponding positions in said token.

17. The method of claim 11, wherein said token body is made of a non-magnetic material.

* * * * *